US006980664B2

(12) United States Patent
Goller

(10) Patent No.: US 6,980,664 B2
(45) Date of Patent: Dec. 27, 2005

(54) DOUBLE-DOME SPEAKER

(75) Inventor: Lars Goller, Herning (DK)

(73) Assignee: Danish Sound Technology A/S, Videbaek (DK)

( * ) Notice: Subject to any disclaimer, the term of this patent is extended or adjusted under 35 U.S.C. 154(b) by 25 days.

(21) Appl. No.: 10/250,574

(22) PCT Filed: Jan. 4, 2002

(86) PCT No.: PCT/DK02/00009

§ 371 (c)(1),
(2), (4) Date: Dec. 16, 2003

(87) PCT Pub. No.: WO02/054826

PCT Pub. Date: Jul. 11, 2002

(65) Prior Publication Data

US 2004/0091130 A1 May 13, 2004

(30) Foreign Application Priority Data

Jan. 4, 2001 (DK) ..... 2001 00013

(51) Int. Cl.[7] ..... H04R 25/00
(52) U.S. Cl. ..... 381/186; 381/412; 381/424; 381/430

(58) Field of Search ..... 381/182, 186, 381/340, 343, 396, 400–401, 412, 414, 420–424, 381/430; 181/144, 147, 157, 163, 164, 165, 181/171–173

(56) References Cited

U.S. PATENT DOCUMENTS

| | | | | |
|---|---|---|---|---|
| 3,509,290 | A * | 4/1970 | Mochida et al. | 381/431 |
| 3,665,124 | A * | 5/1972 | Sotome | 381/401 |
| 4,709,392 | A * | 11/1987 | Kato et al. | 381/430 |
| 5,339,286 | A * | 8/1994 | Esposto | 367/140 |
| 5,548,657 | A * | 8/1996 | Fincham | 381/182 |
| 5,604,815 | A * | 2/1997 | Paddock | 381/396 |
| 6,647,122 | B1 * | 11/2003 | Jones | 381/182 |

FOREIGN PATENT DOCUMENTS

JP 10-108294 4/1998

* cited by examiner

*Primary Examiner*—Huyen Le
(74) *Attorney, Agent, or Firm*—Nixon Peabody LLP; David S. Safran

(57) ABSTRACT

A loudspeaker comprising a moving coil and a membrane fastened to a chassis, where the membrane is divided into a concentrically disposed inner membrane part and a concentrically disposed outer membrane part, whereby a meeting area is defined between the inner membrane part and the outer membrane part, the inner membrane part being fastened to an inner moving coil and the outer membrane part being fastened to an outer moving coil.

18 Claims, 1 Drawing Sheet

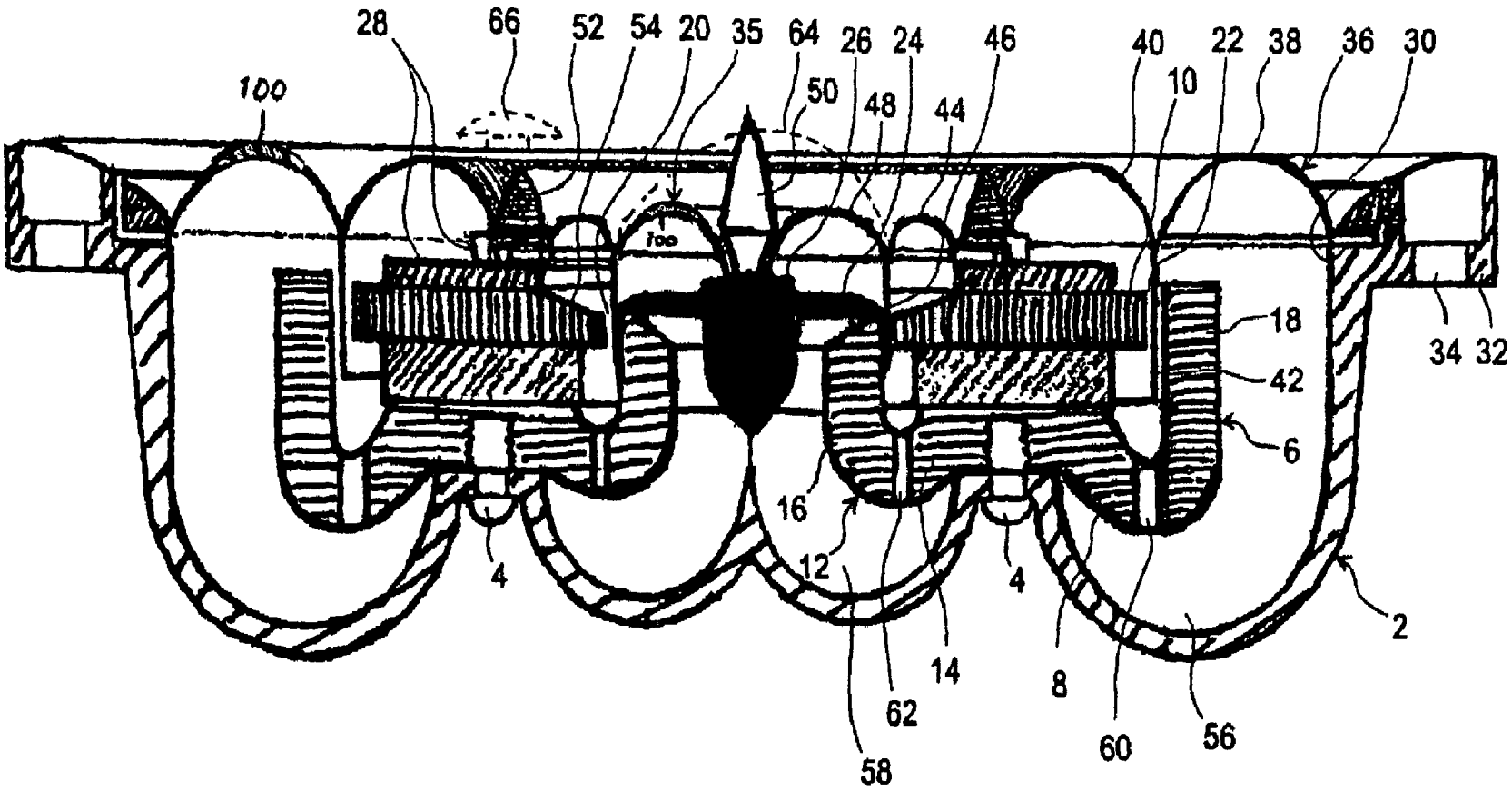
32
34
30
36
38
22
10
40
46
44
24
48
26
50
64
35
20
54
52
66
28
100
2
18
42
6
56
60
8
4
14
62
58
12
16
4

DOUBLE-DOME SPEAKER

The present invention concerns a loudspeaker of the type in which a loudspeaker membrane is coupled to an moving coil disposed in an annular magnet air gap for energising the membrane in accordance with the current changes occurring in the moving coil.

The invention thus concerns a loudspeaker including a moving coil and a membrane fastened to a chassis.

This is the completely elementary basis for the loudspeaker technology normally used.

For different reasons, different kinds of loudspeaker designs are utilized, being particularly adapted for reproducing the sound in respective, discrete frequency ranges with particular quality and efficiency, of the well known terms "woofer" and "tweeter", possibly even "squawker". These units may then be produced separately and assembled in special speaker enclosures for good reproduction of the whole sound spectre.

In JP10-108294-A discloses a speaker which has a 1st diaphragm fitted to a frame, and a 2nd diaphragm adhered to the 1st diaphragm, a roll edge is adapted for peripheral edge part of the 1st diaphragm and the 2nd diaphragm is adhered to the other part than the edge part of the 1st diaphragm. Since the stiffness of the entire diaphragm is improved and the mass is increased by adhering the 2nd diaphragm to the 1st diaphragm, the low sound resonance frequency is decreased more than that of a conventional speaker. Furthermore, since the thickness of the 2nd diaphragm is thicker than the thickness of the 1st diaphragm, the entire stiffness of the double dome diaphragm is much more improved than the case that the thickness of the 2nd diaphragm is equal to or thinner than the thickness of the 1st diaphragm and also the mass is considerably increased.

By the present invention it has been realised that both with regard to production and to function, it will be advantageous to utilise an integrated speaker design for reproducing respective discrete frequency ranges, namely by using two or more concentric, moving coils coupled in parallel and suspended with reference to one and the same speaker chassis. The coupled moving coils have connection to respective discrete membrane parts which are particularly suited for reproducing relevant part frequency ranges, e.g. bass, treble and intermediate tone.

With regard to production, hereby is achieved a considerable simplification thereby, in that differently configured speaker units may be built upon one and the same chassis and thus thereby reduce the number of separately produced loudspeakers. With regard to function, the significant advantage is achieved that the sound picture will be transmitted from one and the same central area.

According to the invention, this is achieved with a loudspeaker of the above-mentioned type being peculiar in that the membrane is divided into a concentrically disposed inner membrane part and a concentrically disposed outer membrane part, whereby a meeting area is defined between the inner membrane part and the outer membrane part, the inner membrane part being fastened to an inner moving coil and the outer membrane part being fastened to an outer membrane part. Hereby is achieved that the relevant frequency ranges may be reproduced by a suitable membrane part. As the different frequency ranges are reproduced from concentric membrane parts, the sound will become radiated in a more suitable manner than by using conventional loudspeakers. The inner and the outer membrane part may be produced in one piece or be composed of several different pieces, possibly of different materials. The freedom of choice provides possibility of making the loudspeaker with a desired quality or price level.

In the following, "inner" is to be understood as being inward against the centre of the loudspeaker and "outer" to be away from the centre, as well as "front" and "back" is to be understood in relation to the listening position.

A further embodiment of the invention is characterized in that the meeting area is held fast to the chassis or a magnet system. The meeting area may be held fast by gluing or with other known technique. By holding fast the meeting area, the individual membrane parts may be better insulated so that vibrations in the individual membrane parts do not influence each other.

A further embodiment of the invention is characterised in that the inner membrane part is a dome, i.e. with a concave shape, which will be particularly suitable if the inner membrane part is to play treble sounds.

A further embodiment of the invention is characterised in that at least one of the membrane parts is a ring dome. A ring dome membrane comprises two concentric, concave, forward directed membrane parts with a moving coil connected to the meeting area of the two concave, forward directed membrane parts. With the use of ring dome membranes is achieved a particularly good reproduction of the sound, mainly because of the fact that the membrane in a ring dome acts as a rolling membrane, where the membrane in a dome more acts as a piston. Each of the forwardly directed membrane parts act as an enlarged edge suspension and are denoted inner and outer edge suspension, respectively.

A further embodiment of the invention is characterised in that the inner membrane part is a ring dome, and that the loudspeaker comprises a centrally disposed wave guide. The use of a centrally disposed wave guide counteracts interference between sound from the different parts of the ring dome. The wave guide is projecting and may be of general conical shape, which will guide the interference-endangered sound waves forwards, or the wave guide may have T-shape which dampens the irradiation from the interference endangered area. The wave guide may be made of a solid material, e.g. plastic or metal.

A further embodiment of the invention is characterised in that the outer membrane part is a ring dome, and that the loudspeaker includes an annular wave guide fastened in the meeting area. The wave guide is projecting and may have tapering shape, which with guide the interference-endangered sound waves forward, or the wave guide may have a T-shape dampening the radiation from the interference-endangered area. Hereby is prevented interference arising between the outer and inner membrane part, something with has appeared to give a measurable better sound reproduction.

A further embodiment of the invention is characterised in that the loudspeaker includes a magnet system including an annular magnet that defines an inner magnet edge and an outer magnet edge with a front annular pole disc and a back pole member in the form of a ring bowl defining an inner air gap along the inner magnet edge between the pole disc and the ring bowl and an outer air gap along the outer magnet edge between the pole disc and the ring bowl. Hereby is achieved that the loudspeaker may be produced with a single magnet ensuring the necessary magnetic field for both moving coils whereby the cost of production may be reduced.

A further embodiment of the invention is characterised in that the annular magnet includes several different magnet pieces. By using several, different magnet pieces, possibly of different materials and with different strengths, the magnetic field around the moving coil may be made with different strength. The different magnet pieces may be disposed spaced apart so that there are parts of the moving coil which are not placed in a magnetic field. The advantage of the above mentioned configurations of the annular magnet is that the characteristic of the loudspeaker may be changed.

A further embodiment of the invention is characterised in that the chassis and the membrane parts delimit a closed space. The loudspeaker may thus be made as a pressure chamber speaker.

A further embodiment of the invention is characterised in that at least one of the membrane parts includes cut-outs or grooves, the cut-outs or grooves being filled with one or more different materials that are different from the greater part of the membrane. In a number of cases it may be suitable to change the properties of the membrane. As it is not always possible to find a material with the right properties, the properties may be modified by making cut-outs or grooves in the shape of recesses in the membrane. The cut-outs or grooves may have different shapes and may subsequently be filled up with different materials, e.g. glue, rubber, silicone, and the like.

A further embodiment of the invention is characterised in that the loudspeaker comprises at least two concentrically disposed outer membrane parts. Use of several outer concentric outer membrane parts enables adapting individual membrane parts to a narrower frequency range with consequently better sound reproduction. It will also be possible to extend the frequency range that may be reproduced by the loudspeaker by e.g. adding an outer membrane which is intended for reproducing bass tones. The loudspeaker may thus comprise three or more membrane parts with each their moving coil.

An embodiment of the invention is explained in more detail in the following with reference to the drawings in which:

The sole figure is a detailed sectional view of a loudspeaker built-up according to the principle of the invention.

A further embodiment of the invention is characterised in that the membrane is made of silk, plastic, paper, cardboard, fabric, aluminium, titanium or another metal.

An embodiment of the invention is explained in more detail in the following with reference to the drawing which is a sectional view of a loudspeaker built up according to the said principle, and which furthermore displays further new characteristics.

The obligatory loudspeaker membrane is divided into two completely separate and independent membranes, namely an outer membrane 36 extending radially between the holder surfaces 28 and 30 and a membrane part 35, the outer edge of which is fastened to the ring projection 28. The inner membrane part 35 is separated from the outer membrane part 36 by a meeting area at the holder surface 28. An inner moving coil 46 is arranged in an inner air gap 20 and is connected to the inner membrane part 35 and an outer moving coil 42 is arranged in an outer air gap 22 and is connected to the outer membrane part 36. As is pertinent to some of the advantageous embodiments of the invention, the membrane parts may be provided with slits, cut outs or grooves 100. The slits, cut-outs or grooves 100 may be filled with a material, such as glue, rubber, silicone or the like. By providing slits, cut-outs or grooves 100, the characteristics of the membrane may be adjusted or fine tuned, whereby even better sound reproduction may be obtained.

The front end of the inner side wall 16 is utilised as carrier for a number of radial arms 24 which radiate from a central support block 26 for the loudspeaker membrane mentioned below. At the front side of the front pole piece 10 there is a ring projection 28 which likewise is carrying membrane. A further membrane carrier surface 30 occurs at the front edge of the outer chassis 2 and from this area a collar part 32 with holes 34 projects outwards for screw fastening of the loudspeaker onto a relevant base.

The obligatory loudspeaker membrane is divided into two completely separate and independent membranes, namely an outer membrane 36 extending radially between the holder surfaces 28 and 30 and a membrane part 35, the outer edge of which is fastened to the projection 28.

The outer membrane part 36 is divided into two interconnected annular sections 38,40 each of which are forward domed and at their meeting area coupled to an outer moving coil 42 working in the outer annular air gap 22. Both membrane parts 38 and 40 will hereby act as "rolling membranes" more than as conventional "pistons", and it has been found that is provides high quality in the sound reproduction of the loudspeaker. The outer edge suspension 38 will act as a conventional, but enlarged edge suspension which by itself will be significant as sound generator. However, it will appear that also the inner edge suspension 40 will act as an enlarged edge suspension at the opposite side.

The inner membrane 35 is built up according the same principle, i.e. with an outer edge suspension 44 forming a "ring dome" connecting the carrying projection 28 with a separate inner moving coil 46 working in the inner ring gap 20, and with an opposite inner edge suspension 48 extending between this moving coil and the central carrier block 26.

In connection with the inner membrane part concerned, it may be advantageous to place a projecting, generally conical wave guide body 50 on the central part of the carrier block 26, as interferences between the sound wave transmitted from the mutually facing inner surfaces of the inner edge suspension 48 are hereby counteracted. By the present invention it has been realised that a corresponding principle may advantageously be utilised in connection with the ring division between the outer and the inner membrane parts 36 and 35, namely by mounting a projecting and forwardly tapering ring 52 in the annular meeting area between the membrane parts 36 and 35, i.e. with fixed mounting on the supporting chassis ring part 28. This ring 52 with its forwardly tapering shape will ensue that tangible interferences are not created between the sound waves transmitted from the outer side of the inner membrane 35 and the inner side of the surrounding outer membrane 36, respectively.

It will be seen that the front pole piece 10 at its front side is made with a recess 54 facing inward against the inner ring gap 20. Hereby, one and the same pole piece may be used for unilateral limitation of a shorter ring gap for the treble moving coil 46 and a longer ring gap for the tangibly longer low frequency moving coil 42, respectively.

From the Figure is readily seen that the fixed and quite closed chassis bowl 2 is formed with curve profiled ring chambers 56 and 58 behind respective outer and inner membrane parts 36 and 35, and that these chambers through annular rows of holes or slots 60 and 62 are connected with ring chambers behind respective ring gaps 22 and 20. In the shown embodiment, it is a pressure chamber speaker where there is only provided for occurring pulsating air currents to run along wave guide faces so that internal interferences are counteracted.

The chassis bowl 2 is moulded in a well heat conducing material, such as aluminium, whereby the trapped air volumes and thereby the moving coils may be held cooled by the ambient air.

The invention is not in any way limited to the shown embodiment as other membrane types may be chosen and possibly may be added one or more further ring sections. By 64 it is outlined punctuated as an example that the inner edge suspension 48 may be substituted by an ordinary dome whereby the central support block 26 becomes superfluous; in that case the associated outer edge suspensions 44 should be limited in size.

At the embodiment shown, it will be possible to substitute the tapering ring 52 with a T-profiled ring the cross-bar of which, as outlined by 66, extends somewhat in over the mutually facing inner edge suspension 40 of the outer membrane part and the outer edge suspension 44 of the inner membrane part. Instead of countering interferences in this area by means of the wave guide ring 52, one may thus dampen the radiation from the area. The screen part 66 should, however, ideally be optimized in shape with regard to the occurring difference in size between the membrane sections in question.

What is claimed is:

1. A loudspeaker including an moving coil and a membrane fastened to a chassis, wherein the membrane is divided into a concentrically disposed inner membrane part and a concentrically disposed outer membrane part, whereby a meeting area is defined between the inner membrane part and the outer membrane part, the inner membrane part being fastened to an inner moving coil and the outer membrane part being fastened to an outer moving coil; wherein the meeting area is held fast to the chassis or magnet, and wherein the loudspeaker includes a magnet system including an annular magnet that defines an inner magnet edge and an outer magnet edge with a front annular pole disc and a back pole member in the form of a ring bowl defining an inner air gap along the inner magnet edge between the pole disc and the ring bowl and an outer air gap along the outer magnet edge between the pole disc and the ring bowl.

2. A loudspeaker according to claim 1, characterised in that the inner membrane part is a dome.

3. A loudspeaker according to claim 2, characterised in that an least one of the membrane parts is a ring dome.

4. A loudspeaker according to claim 1, characterised in that an least one of the membrane parts is a ring dome.

5. A loudspeaker according to claim 4, characterised in that the inner membrane part is a ring dome, and that the loudspeaker comprises a centrally placed wave guide.

6. A loudspeaker according to claim 4, characterised in that the outer membrane part is a ring dome, and that the loudspeaker includes an annular wave guide fastened in the meeting area.

7. A loudspeaker according to claim 1 characterised in that the annular magnet includes several different magnet pieces.

8. A loudspeaker according to claim 7, characterised in that the chassis and the membrane parts delimit a closed space.

9. A loudspeaker according to claim 1, characterised in that the chassis and the membrane parts delimit a closed space.

10. A loudspeaker according to claim 9, characterised in that at least one of the membrane parts includes cut-outs or grooves, the cut-outs or grooves being filled with one or more different materials that are different from a greater part of the membrane.

11. A loudspeaker according to claim 1, characterised in that at least one of the membrane parts includes cut-outs or grooves, the cut-outs or grooves being filled with one or more different materials that are different from a greater part of the membrane.

12. A loudspeaker according to claim 11, characterised in that the loudspeaker includes at least two concentrically disposed outer membrane parts.

13. A loudspeaker according to claim 1, characterised in that the loudspeaker includes at least two concentrically disposed outer membrane parts.

14. A loudspeaker according to claim 13, characterised in that the chassis is made from plastic, iron or aluminium.

15. A loudspeaker according to claim 1, characterised in that the chassis is made from plastic, iron or aluminium.

16. A loudspeaker according to claim 15, characterised in that the membrane is made from silk, plastic, paper, cardboard, aluminium, titanium, or another metal.

17. A loudspeaker according to claim 1, characterised in that the membrane is made from silk, plastic, paper, cardboard, aluminium, titanium, or another metal.

18. A loudspeaker according to claim 1, characterised in that the inner membrane part is a dome.

* * * * *